US010182658B2

(12) United States Patent
Harkey et al.

(10) Patent No.: US 10,182,658 B2
(45) Date of Patent: Jan. 22, 2019

(54) LUMBAR SUPPORT SYSTEM

(71) Applicants: Deborah Harkey, Monroe, NC (US); Tonya Smith, Lancaster, SC (US)

(72) Inventors: Deborah Harkey, Monroe, NC (US); Tonya Smith, Lancaster, SC (US)

( * ) Notice: Subject to any disclaimer, the term of this patent is extended or adjusted under 35 U.S.C. 154(b) by 97 days.

(21) Appl. No.: 15/261,251

(22) Filed: Sep. 9, 2016

(65) Prior Publication Data

US 2018/0070730 A1 Mar. 15, 2018

(51) Int. Cl.

| | |
|---|---|
| ***A47C 7/74*** | (2006.01) |
| ***A47C 7/42*** | (2006.01) |
| ***A47C 7/46*** | (2006.01) |
| ***A47C 31/11*** | (2006.01) |

(52) U.S. Cl.

CPC ..... *A47C 7/748* (2013.01); *A47C 7/425* (2013.01); *A47C 7/46* (2013.01); *A47C 31/11* (2013.01)

(58) Field of Classification Search

CPC ..... A47C 7/425; A47C 7/46; A47C 7/748; A47C 31/11

USPC ..... 297/228.1

See application file for complete search history.

(56) References Cited

U.S. PATENT DOCUMENTS

| | | | | |
|---|---|---|---|---|
| 4,206,945 | A * | 6/1980 | Kifferstein | A47C 7/386 297/220 |
| 5,533,787 | A * | 7/1996 | Xiang | B60N 2/4879 297/228.1 |
| 5,545,198 | A | 8/1996 | Owens | |
| 5,660,438 | A | 8/1997 | Tedesco | |
| 5,707,107 | A * | 1/1998 | Melone | B60N 2/6027 297/228.1 |
| 5,816,654 | A | 10/1998 | Ellis | |
| 6,079,784 | A * | 6/2000 | Peachey | B60N 2/6036 297/284.5 |
| 7,744,153 | B2 | 6/2010 | Gentry et al. | |
| 7,841,658 | B1 * | 11/2010 | Marble | B60N 2/4879 150/158 |
| 8,556,337 | B1 | 10/2013 | Cornitius-Cary | |
| 8,870,281 | B1 * | 10/2014 | Boone | A47C 7/746 297/180.1 |

* cited by examiner

*Primary Examiner* — David R Dunn
*Assistant Examiner* — Tania Abraham

(57) ABSTRACT

A lumbar support system includes a chair that has a backrest. The backrest has a forward side. At least one lumbar pillow is provided. A slip cover is provided. The slip cover is selectively positioned over the backrest. The slip cover has a plurality of pockets. The at least one lumbar pillow is positioned in a selected one of the pockets. Thus, the lumbar pillow may support lumbar vertebrae.

4 Claims, 5 Drawing Sheets

LUMBAR SUPPORT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98.

The disclosure and prior art relates to support devices and more particularly pertains to a new support device for mounting a lumbar pillow on a chair.

BRIEF SUMMARY OF THE INVENTION

An embodiment of the disclosure meets the needs presented above by generally comprising a chair that has a backrest. The backrest has a forward side. At least one lumbar pillow is provided. A slip cover is provided. The slip cover is selectively positioned over the backrest. The slip cover has a plurality of pockets. The at least one lumbar pillow is positioned in a selected one of the pockets. Thus, the lumbar pillow may support lumbar vertebrae.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
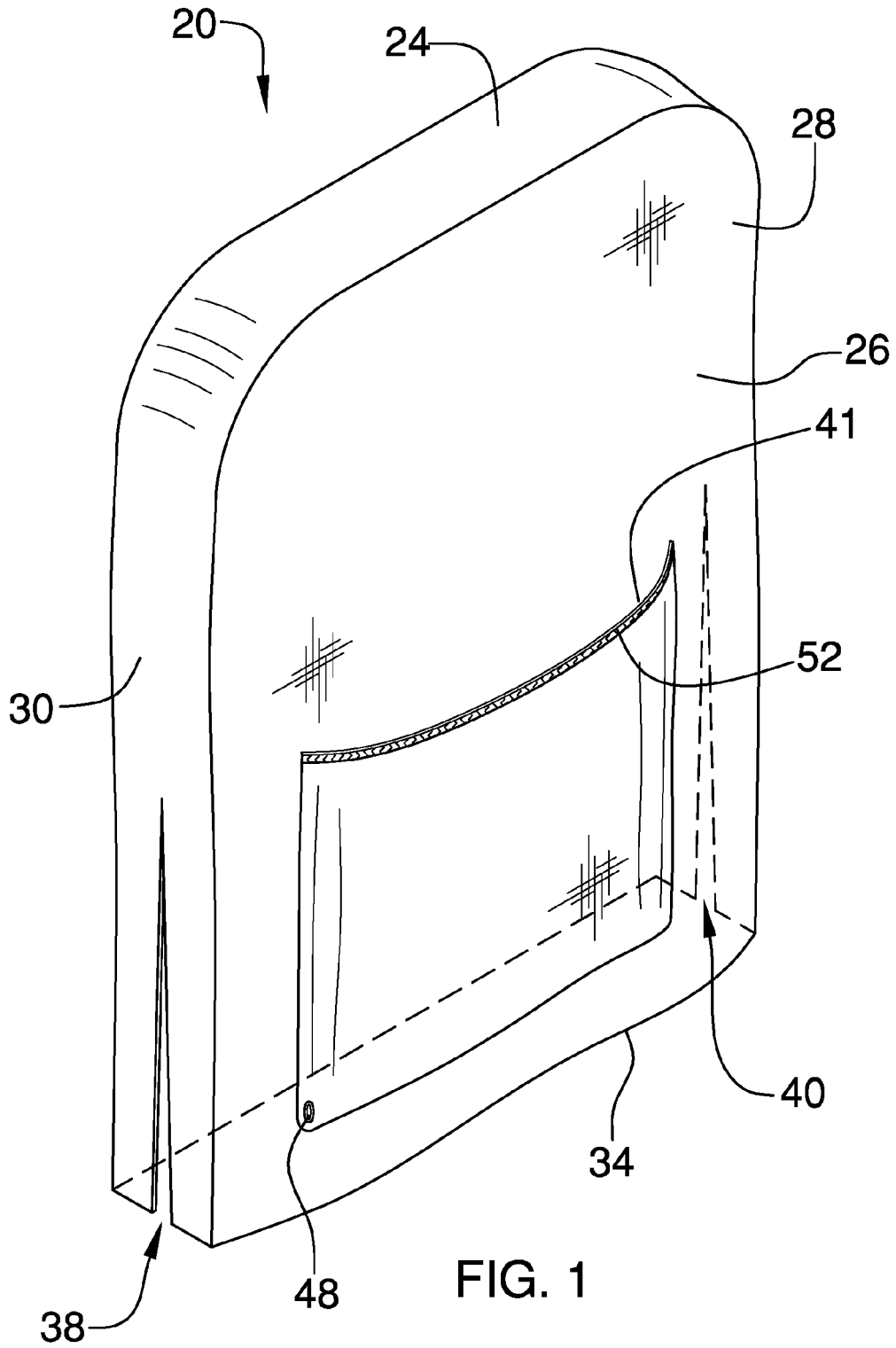
FIG. 1 is a front perspective view of a slip cover of a lumbar support system according to an embodiment of the disclosure.
Figure 3:
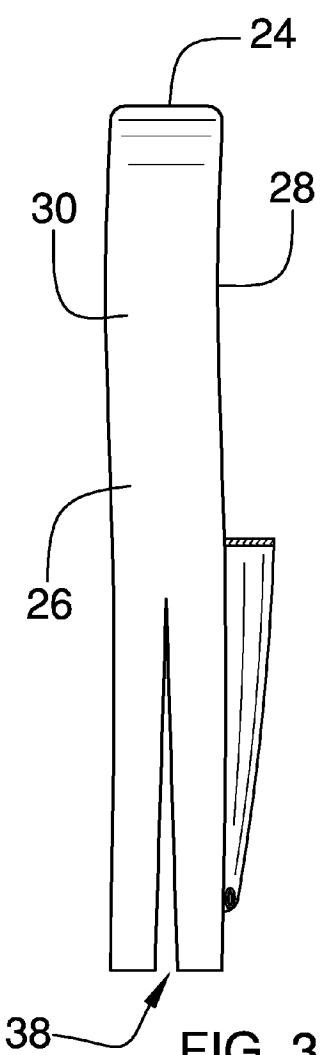
FIG. 3 is a right side view of a slip cover of an embodiment of the disclosure.
Figure 2:
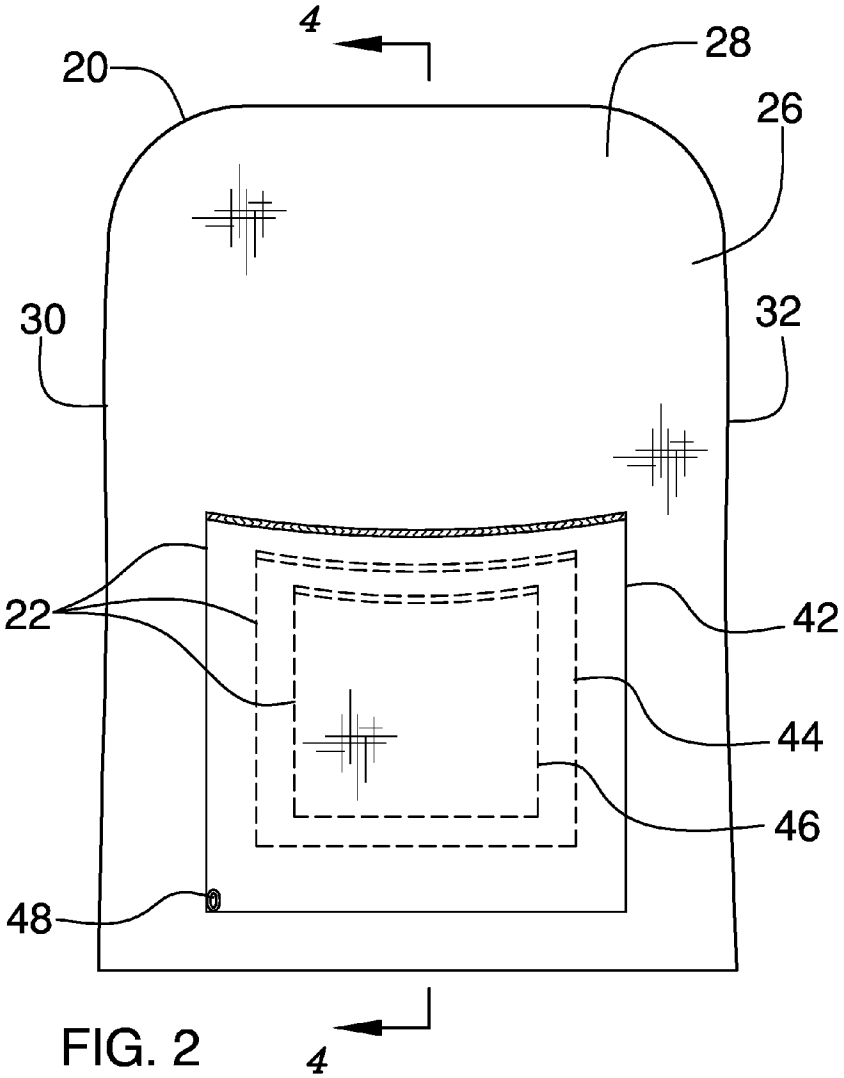
FIG. 2 is a front phantom view of a slip cover of an embodiment of the disclosure.
Figure 4:
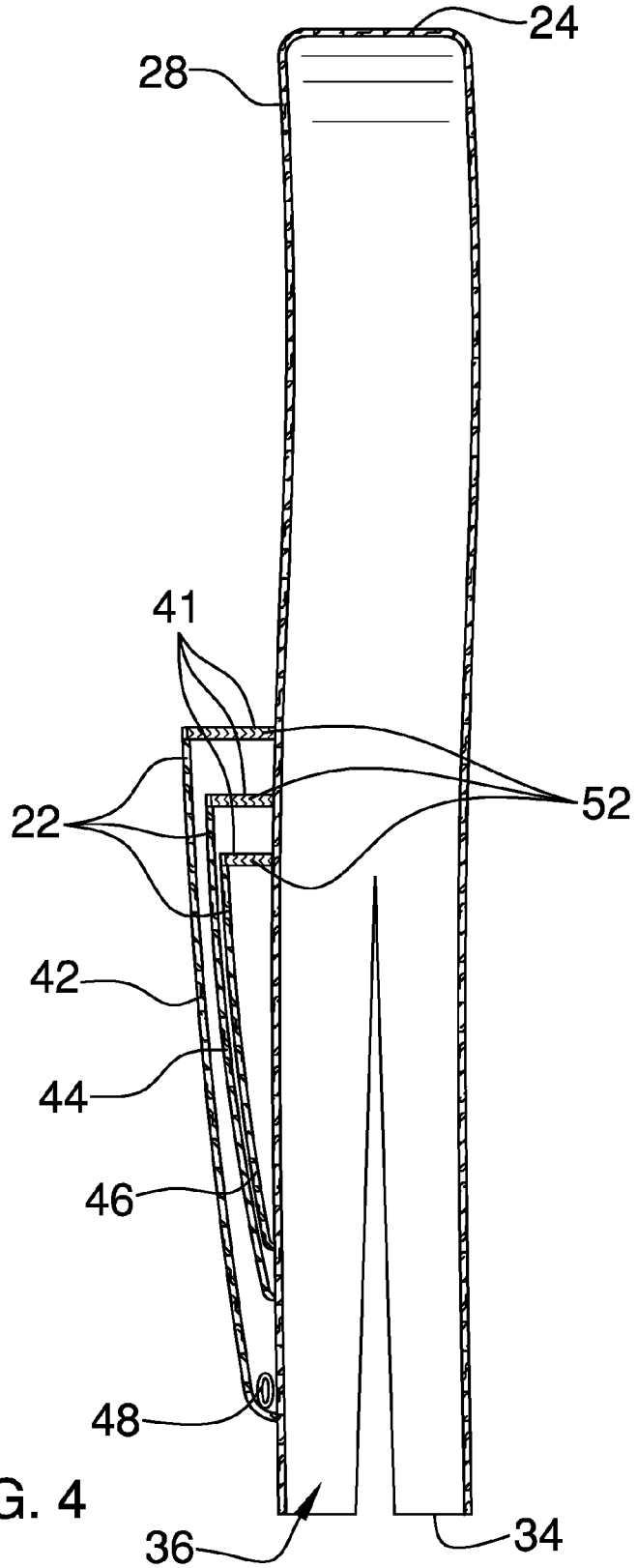
FIG. 4 is a cross sectional view taken along line 4-4 of FIG. 2 of an embodiment of the disclosure.
Figure 5:
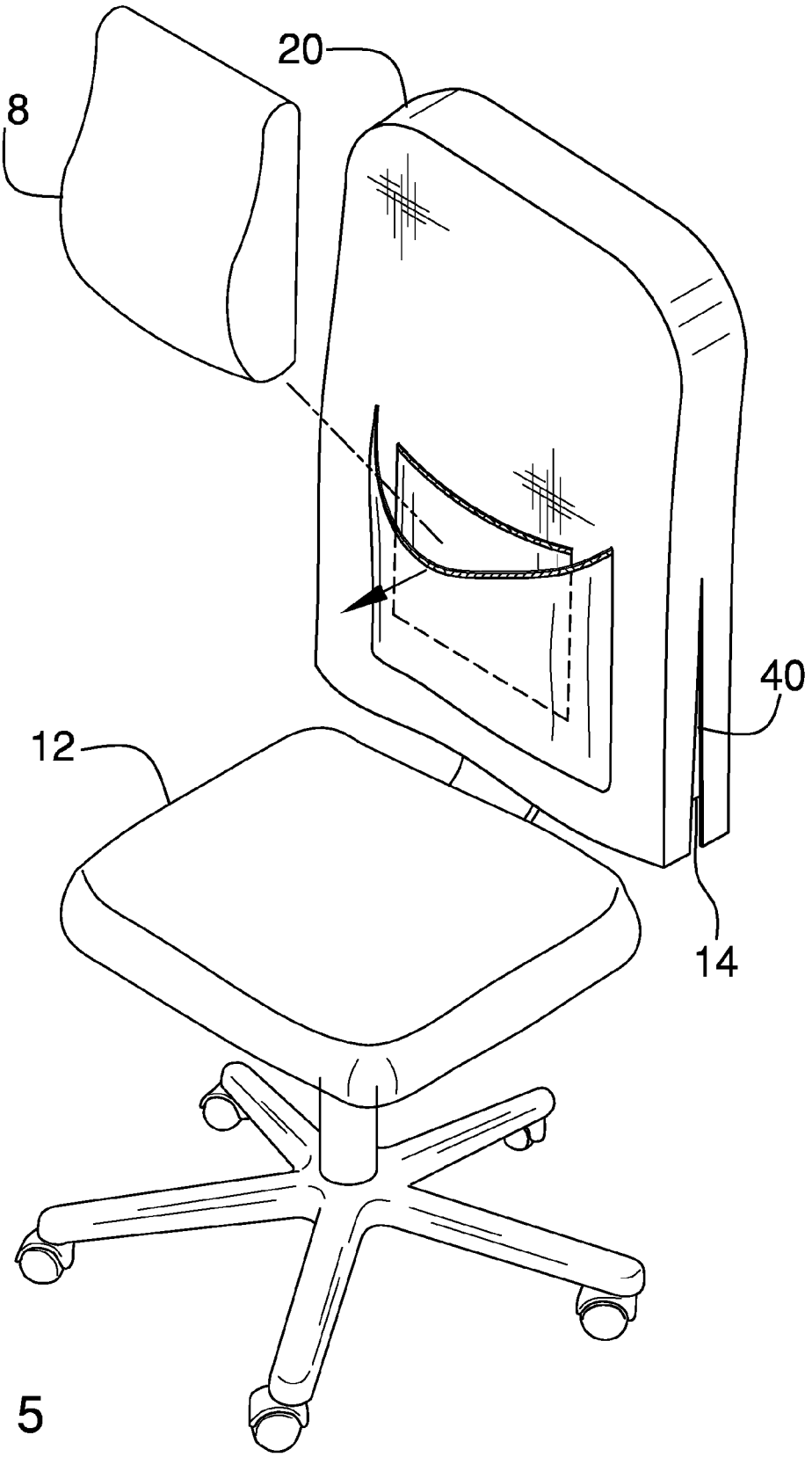
FIG. 5 is a front perspective in-use view of an embodiment of the disclosure.
Figure 6:
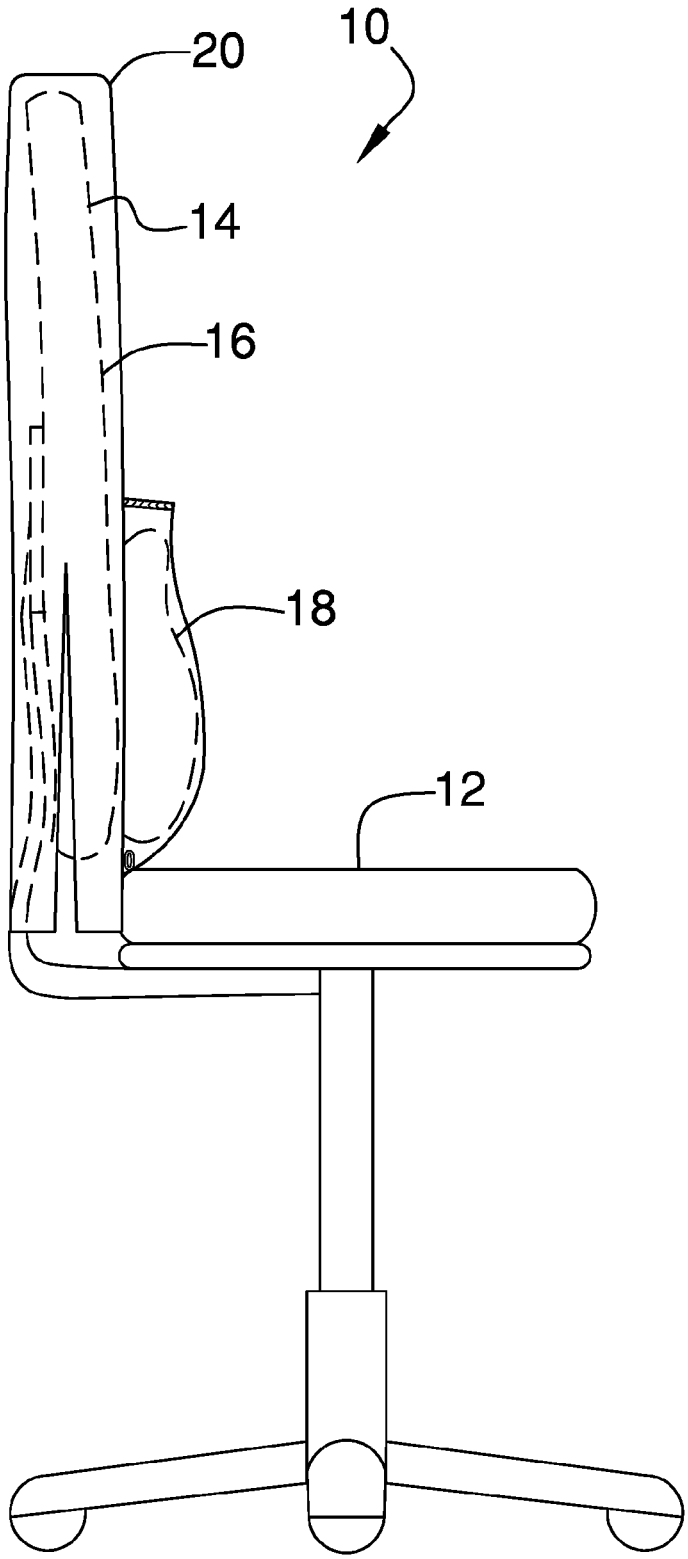
FIG. 6 is a right side phantom view of an embodiment of the disclosure.

With reference now to the drawings, and in particular to FIGS. 1 through 6 thereof, a new support device embodying the principles and concepts of an embodiment of the disclosure and generally designated by the reference numeral 10 will be described.

As best illustrated in FIGS. 1 through 6, the lumbar support system 10 generally comprises a chair 12 that has a backrest 14. The backrest 14 has a forward side 16. The chair 12 may be an office chair 12 or the like. At least one lumbar pillow 18 is provided.

A slip cover 20 is provided. The slip cover 20 is selectively positioned over the backrest 14. The slip cover 20 has a plurality of pockets 22. The at least one lumbar pillow 18 is positioned in a selected one of the pockets 22. Thus, the lumbar pillow 18 may support lumbar vertebrae.

The slip cover 20 has a top wall 24 and an outer wall 26 extending downwardly from the top wall 24. The outer wall 26 has a front side 28, a first lateral side 30 and a second lateral side 32. The outer wall 26 has a distal edge 34 with respect to the top wall 24. The distal edge 34 defines an opening 36 into the slip cover 20. The backrest 14 is extended into the opening 36 having the front side 28 of the cover positioned on the forward side 16 of the backrest 14.

The outer wall 26 has a first cut 38 extending upwardly from the distal edge 34. The first cut 38 may be positioned on the first lateral side 30 of the slip cover 20. The outer wall 26 has a second cut 40 extending upwardly from the distal edge 34. The second cut 40 may be positioned on the second lateral side 32 of the slip cover 20.

Each of the pockets 22 is coupled to the front side 28 of the cover. Each of the pockets 22 has a top edge 41. The top edge 41 of each of the pockets 22 defines an opening 36 into the pockets 22. The plurality of pockets 22 includes a first pocket 42, a second pocket 44 and a third pocket 46. The first pocket 42 surrounds the second pocket 44. The second pocket 44 surrounds the third pocket 46.

The first pocket 42 has an aperture 48 extending therethrough. A power cord may be extended through the aperture 48. The power cord may be a power cord for a heating pad or the like. The heating pad may be positioned in the first pocket 42. The heating pad may be an electric heating pad or the like.

A plurality of elastic members 52 is provided. Each of the elastic members 52 is coupled to an associated one of the pockets 22. Each of the elastic members 52 is coextensive with the top edge 41 of the associated pocket 22. Each of the elastic members 52 is comprised of a resiliently stretchable material.

In use, the slip cover 20 is positioned over the backrest 14 of the chair 12. The at least one lumbar pillow 18 is positioned in a selected one of the second 44 and third 46 pockets. Thus, the lumbar pillow 18 supports lumbar vertebrae when a user sits in the chair 12. The heating pad may be positioned on the first pocket 42. The power cord for the heating pad may be extended through the aperture 48. Thus, the heating pad may provide therapeutic heat for the lumbar vertebrae.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A lumbar support system comprising:

a chair having a backrest, said backrest having a forward side;

a lumbar pillow; and a slip cover being selectively positioned over said backrest, said slip cover having a plurality of pockets, said lumbar pillow being positioned in a selectable one of said pockets wherein said lumbar pillow is configured to support lumbar vertebrae at a selectable position relative to said slip cover, said pockets overlapping each other defining an outermost pocket, each pocket of said plurality of pockets other than said outermost pocket being nested within said outermost pocket.

2. The system according to claim 1, wherein said slip cover has a top wall and an outer wall extending downwardly from said top wall, said outer wall having a front side, said outer wall having a distal edge with respect to said top wall, said distal edge defining an opening into said slip cover, said backrest being extended into said opening having said front side of said cover being positioned on said forward side of said backrest, each of said pockets being coupled to said front side of said cover, each of said pockets having a top edge, said top edge of each of said pockets defining an opening into said pocket.

3. The system according to claim 2, further comprising a plurality of elastic members, each of said elastic members being coupled to an associated one of said pockets, each of said elastic members being coextensive with said top edge of said associated pocket.

4. A lumbar support system comprising:

a chair having a backrest, said backrest having a forward side;

at least one lumbar pillow;

a slip cover being selectively positioned over said backrest, said slip cover having a plurality of pockets, said at least one lumbar pillow being positioned in a selected one of said pockets wherein said lumbar pillow is configured to support lumbar vertebrae at a selectable position relative to said slip cover, said slip cover having a top wall and an outer wall extending downwardly from said top wall, said outer wall having a front side, said outer wall having a distal edge with respect to said top wall, said distal edge defining an opening into said slip cover, said slip cover having a first lateral side and a second lateral side, said outer wall having a first cut extending from said distal edge on said first lateral side of said slip cover, said outer wall having a second cut extending from said distal edge on said second lateral side of said slip cover wherein said first cut and said second cut facilitate said backrest being extended into said opening having said front side of said cover being positioned on said forward side of said backrest, each of said pockets being coupled to said front side of said cover, each of said pockets having a top edge, said top edge of each of said pockets defining an opening into said pocket, said pockets overlapping each other defining an outermost pocket, each pocket of said plurality of pockets other than said outermost pocket being nested within said outermost pocket; and a plurality of elastic members, each of said elastic members being coupled to an associated one of said pockets, each of said elastic members being coextensive with said top edge of said associated pocket.

* * * * *